US005988634A

United States Patent [19]

Elrick et al.

[11] Patent Number: 5,988,634

[45] **Date of Patent: *Nov. 23, 1999**

[54] APPARATUS FOR DETECTING THE PASSAGE OF MULTIPLE SUPERPOSED SHEETS ALONG A FEED PATH

[75] Inventors: Alexander D. Elrick, Dundee; Alan R. Greig, Perthshire; Alexander W. Logie, West Lothian, all of United Kingdom

[73] Assignee: NCR Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/892,321

[22] Filed: Jul. 14, 1997

[30] Foreign Application Priority Data

Dec. 24, 1996 [GB] United Kingdom ..... 9626835

[51] Int. Cl.[6] ..... B65H 7/12

[52] U.S. Cl. ..... 271/265.04; 271/263; 364/563

[58] Field of Search ..... 271/263; 364/563, 364/479

[56] References Cited

U.S. PATENT DOCUMENTS

| | | | |
|---|---|---|---|
| 4,491,929 | 1/1985 | Ikoma et al. | 271/263 X |
| 4,815,015 | 3/1989 | Milne | 271/263 X |
| 4,894,783 | 1/1990 | Milne | 271/263 X |

FOREIGN PATENT DOCUMENTS 0344938 12/1989 European Pat. Off. .

*Primary Examiner*—William E. Terrell
*Assistant Examiner*—Gene O. Crawford

[57] ABSTRACT

An apparatus for detecting the passage of superposed sheets, e.g. currency notes, along a feed path (76) includes a mechanism which has a pair of cooperating rollers (12, 14) and which is arranged to generate an output voltage whose magnitude varies in response to the passage of an item (single or multiple sheet) between the rollers (12, 14). This output voltage is applied to an A/D converter whose outputs are sampled at regular intervals while an item is passing between the rollers (12, 14). A data processing means generates a first digital value representative of the sum of these outputs. From this digital value is subtracted a value representative of the sum of the outputs of the A/D converter over the corresponding part of the cycle of the rollers while no sheet is passing between them. A determination is thereby made as to whether or not said item comprises a single sheet.

10 Claims, 4 Drawing Sheets

APPARATUS FOR DETECTING THE PASSAGE OF MULTIPLE SUPERPOSED SHEETS ALONG A FEED PATH

BACKGROUND OF THE INVENTION

This invention relates to an apparatus for detecting the passage of multiple superposed sheets along a feed path. The invention has application, for example, to an apparatus for detecting the passage of superposed currency notes in a cash dispensing mechanism of an automated teller machine (ATM).

In a cash dispensing mechanism, it is important to provide a simple and reliable means for detecting when a currency note has become superposed on another in a path of travel from a currency supply means to a note exit slot, since such superpositioning may produce an undesirable result such as the dispensing of an excessive amount of money. For convenience, two or more sheets or notes which have become disposed in a superposed relationship will hereinafter be referred to as a multiple sheet or a multiple note.

From EP-B-0344938 there is known an apparatus for detecting multiple sheets. This apparatus includes first and second cooperating rollers between which sheets pass as they are fed along a feed path, the first roller having a fixed axis of rotation, and the second roller being resiliently urged towards the first roller so as to enable it to be moved away from the first roller as a single or multiple sheet passes between the rollers. A voltage generating means associated with the second roller produces an output voltage which varies linearly with movement of the second roller towards or away from the first roller, and this output voltage is applied to an analog-to-digital (A/D) converter. A data processor is connected to the output of the A/D converter and is arranged to perform the steps of: sampling the value of said output voltage (as represented by the output of the AID converter) a predetermined number of times for an integral number (which may be one) of complete revolutions of one of the rollers when no sheet is passing between the rollers, the diameter of this roller being equal to or a multiple of the diameter of the other roller; storing a first digital value representative of the sum of the values sampled in the last-mentioned step; sampling the value of said output voltage said predetermined number of times for an integral number of complete revolutions of said one of the rollers when an item comprising a single or multiple sheet is passing between the rollers; storing a second digital value representative of the sum of the values sampled in the last-mentioned step; and subtracting the first digital value from the second digital value to produce a third digital value on the basis of which a determination is made as to whether a single or multiple sheet has passed between the rollers.

As mentioned in the above-identified document, an advantage of this apparatus is that by virtue of subtracting said first digital value (stored when no sheet is passing between the rollers) from said second digital value (so as to produce said third digital value) possible problems due to roller noise are eliminated. By roller noise is meant variations in the output of said voltage generator brought about by various factors such as bearing wear and tolerances, dirt on the rollers and roller eccentricity.

A limitation of the known apparatus referred to above is that the spacing between the leading edges of successive items fed to the apparatus must be at least as great as the circumference of the larger of the rollers (or at least as great as the circumference of each roller if they are of the same side). Another limitation is that any divert mechanism positioned in said feed path downstream of said rollers must be spaced from the nip of the rollers by a distance at least equal to said circumference.

SUMMARY OF THE INVENTION

It is an object of the invention to provide an apparatus for detecting the passage of superposed sheets along a feed path which does not have the above mentioned limitations, but which retains the above mentioned advantage of the known apparatus.

According to the invention there is provided an apparatus for detecting the passage of superposed sheets along a feed path, including first and second cooperating rollers, said first roller having a fixed axis of rotation, and the diameter of one of said rollers being equal to, or a multiple of, the diameter of the other roller, feed means for feeding sheets along said feed path between said rollers, mounting means for mounting said second roller so that its axis is movable relative to that of said first roller and so that it is biased towards said first roller to enable said second roller to be displaced away from said first roller in response to a single or multiple sheet passing between said first and second rollers, voltage generating means associated with said second roller and arranged to produce an output voltage which varies linearly with movement of the axis of said second roller towards or away from the axis of said first roller, an analog-to-digital converter to which said output voltage is applied, and data processing means connected to the output of said converter, characterized by storage means arranged to store a series of digital values representative of the outputs of said converter at regular intervals over the cycle of said rollers when no sheet is passing between them, and in that said data processing means is arranged to perform the following steps: (a) determining when an item comprising one or more sheets commences to pass between said rollers and determining when said item ceases to pass between said rollers; (b) sampling the outputs of said converter at regular intervals while said item is passing between said rollers; and (c) utilizing the sampled outputs of said converter and those stored digital values corresponding to that part of said cycle for which said item is passing between said rollers to generate a further digital value which is representative of the average thickness of that part of said item engaged by said rollers and on the basis of which a determination is made as to whether or not said item comprises a single sheet.

It should be understood that by a cycle of said rollers is meant the period taken for the larger roller, or for each roller if they are the same size, to make one complete revolution.

Preferably, in operation of an apparatus in accordance with the invention, in step (c) said data processing means is arranged to make a determination as to the number of sheets forming said item.

It should be understood that the ability of an apparatus in accordance with the invention to determine the number of sheets making up a detected multiple sheet is of importance, since when it is used in a cash dispensing mechanism, for example, it enables a record to be kept of the number of notes making up a multiple note which will normally be diverted to a reject bin. Such record will assist in reconciliation procedures when the bin is emptied.

BRIEF DESCRIPTION OF THE DRAWINGS

One embodiment of the present invention will now be described by way of example with reference to the accompanying drawings, in which.

DETAILED DESCRIPTION

Figure 1:
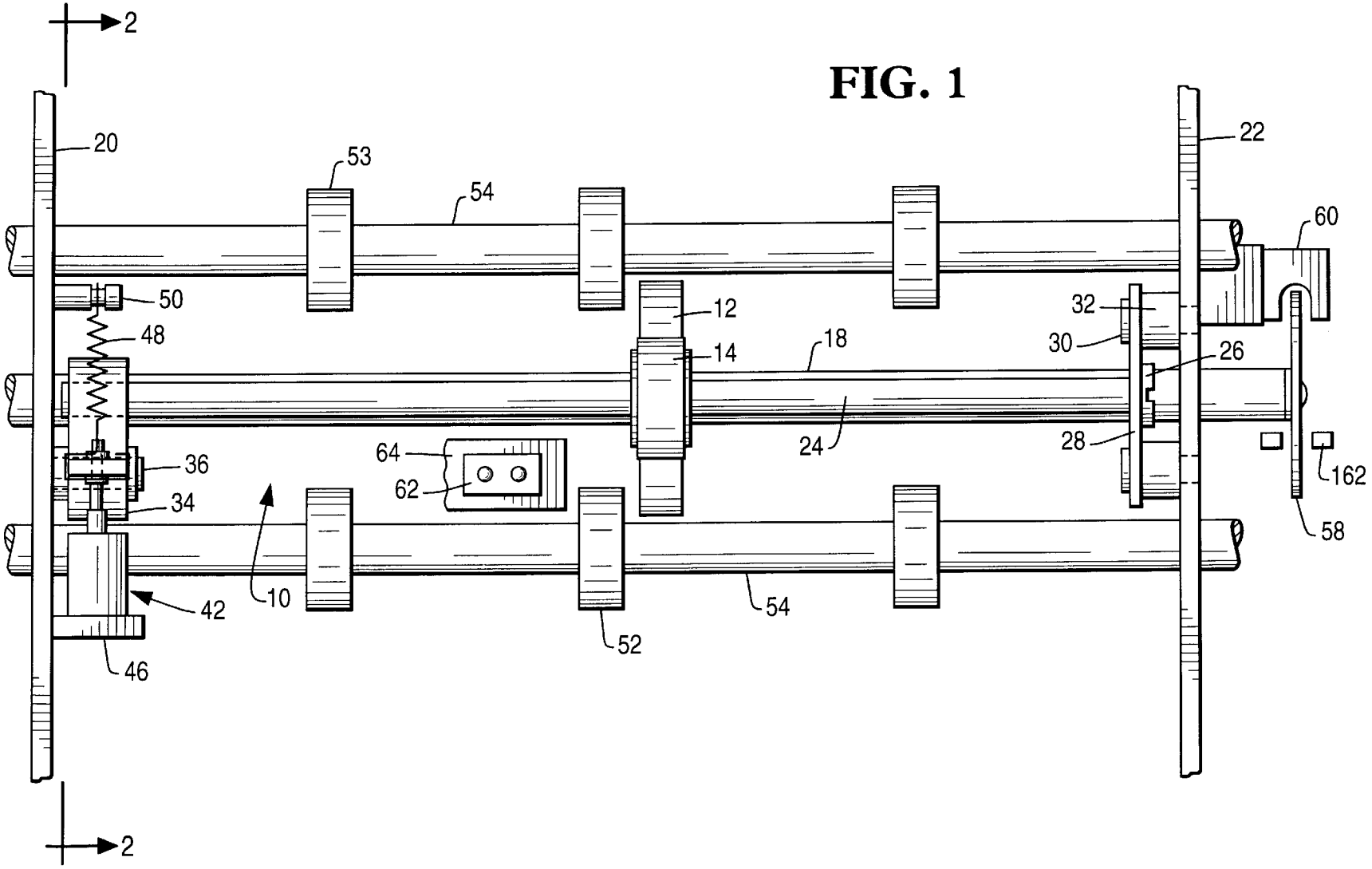
FIG. 1 is a front elevational view of a note sensing mechanism utilized in a multiple note detect apparatus in accordance with the present invention.
Figure 2:
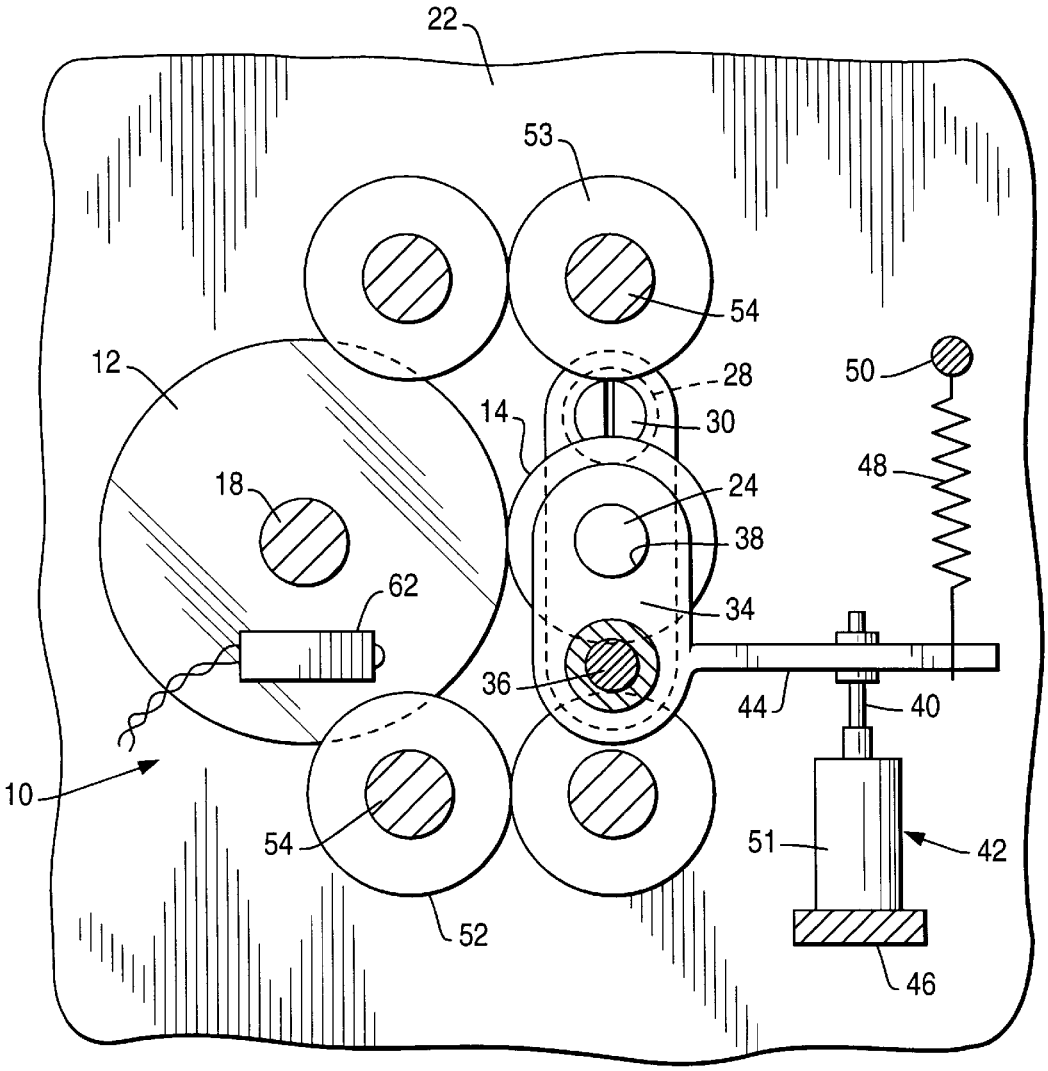
FIG. 2 is a part sectional side elevational view of the note sensing mechanism of FIG. 1 taken along the line 2—2 of FIG. 1.

Referring to FIGS. 1 and 2, a note sensing mechanism 10 of a multiple note detect apparatus in accordance with the invention includes a steel roller 12 having a fixed axis of rotation and a cooperating steel roller 14 having a movable axis of rotation, the diameter of the roller 12 being exactly twice that of the roller 14. In the present embodiment the diameter of the roller 12 is 180 millimeters. As will be explained later, the roller 14 is resiliently urged into engagement with the roller 12, and currency notes are fed in operation between the rollers 12 and 14, with the long dimension of each note extending parallel to the axis of the roller 12.

The roller 12 is secured on a drive shaft 18 which extends between, and is rotatably mounted with respect to, a pair of side frame members 20 and 22, and the roller 14 is rotatably mounted on a rigid rod 24 which, in the absence of any currency note between the rollers 12 and 14, extends parallel to the drive shaft 18. The roller 14 is caused to rotate in operation by virtue of its resilient engagement with the roller 12 or with a note passing between the rollers 12 and 14. The right hand end (with reference to FIG. 1) of the rod 24 is secured by means of a screw 26 to a narrow plate 28 of plastics material which is disposed generally parallel to the side frame member 22. The ends of the plate 28 are secured to the member 22 by means of bolts 30, the plate 28 being spaced from the inner surface of the member 22 by spacer members 32.

A connector member 34 is pivotally mounted on a stud 36 secured to the inner surface of the side frame member 20. That end of the rod 24 remote from the plate 28 is supported by the connector member 34, this end passing through, and being a tight fit with respect to, a circular aperture 38 formed in the connector member 34 above the stud 36. The connector member 34 is connected to a vertically extending armature 40 of a linear variable differential transformer (LVDT) 42 by means of an arm 44 which is formed integral with the connector member 34 and which extends therefrom in a generally horizontal direction. The LVDT 42 is mounted on a bracket 46 secured to the side frame member 20, and the free end of the arm 44 is connected by means of a spring 48 to a stud 50 secured to the member 20, the spring 48 serving to urge the assembly of the connector member 34 and the arm 44 in an anti-clockwise direction (with reference to FIG. 2) about the stud 36. The plate 28 has a certain amount of inherent flexibility, and by virtue of this flexibility the rod 24 is pivotable to some extend about a point substantially at the center of the plate 28. Normally, the roller 14 is urged into engagement with the roller 12 under the action of the spring 48. Upon one or more currency notes passing between the rollers 12 and 14, pivotal movement of the rod 24 is brought about in a direction such that the left hand end (with reference to FIG. 1) of the rod 24 is moved away from the drive shaft 18. This pivotal movement of the rod 24 brings about pivotal movement of the connector member 34 in a clockwise direction (with reference to FIG. 2) about the stud 36 against the action of spring 48, and in turn this movement of the connector member 34 brings about a downward movement of the armature 40 of the LVDT 42 by means of the arm 44. Upon the currency note or notes leaving the nip of the rollers 12 and 14, the spring 48 returns the rod 24 to its home position, with the roller 14 in engagement with the roller 12, and also moves the armature 40 in an upward direction back to its home position via the arm 44. It should be understood that the nature of the guidance of the armature 40 within the housing 51 of the LVDT 42 permits the angular movement of the arm 44 to be translated into up and down movement of the armature 40 over the small extent of pivotal movement of the rod 24 encountered in operation.

Figure 4:
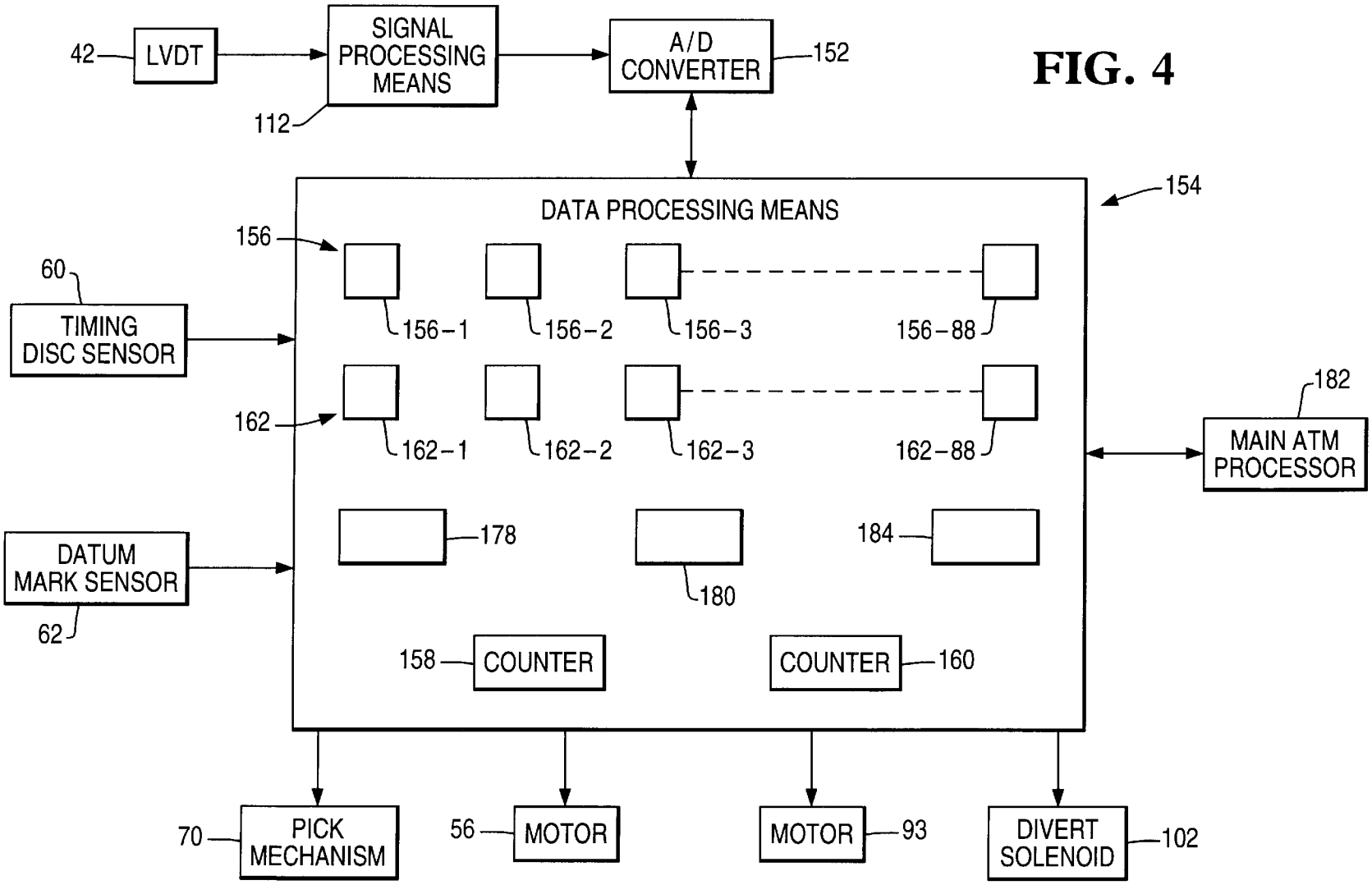
FIG. 4 is a block circuit diagram of the multiple note detect apparatus and associated parts of the cash dispensing mechanism.

Movement of currency notes in an upward direction between the rollers 12 and 14 is brought about by means of pairs of co-operating rubber feed rollers 52 and 53 mounted on shafts 54, the shafts 54 extending between, and being rotatably mounted with respect to, the side frame members 20 and 22. The feed rolls 52 and 53 and the drive shaft 18 for the roller 12 are driven via transmission means (not shown) by an electric motor 56 (FIG. 4). As shown in FIGS. 1 and 2, the feed rolls 52 are positioned beneath the rollers 12 and 14, and the feed rolls 53 are positioned above the rollers 12 and 14.

A timing disc 58 is secured to the end of the drive shaft 18 projecting beyond the side frame member 22, the disc 58 carrying a series of radially extending black regions (not seen) equally spaced around the axis of the shaft 18. The disc 58 co-operates with an optical sensor 60 mounted on the side frame member 22, and in operation the sensor 60 generates a series of equally spaced timing pulses in response to the sensing of the marks carried by the disc 58; 88 timing pulses are generated by the sensor 60 for each complete revolution of the roller 12.

A further optical sensor 62 is arranged to sense a datum mark (not seen) carried on the timing disc 58 for a purpose which will be described later.

Figure 3:
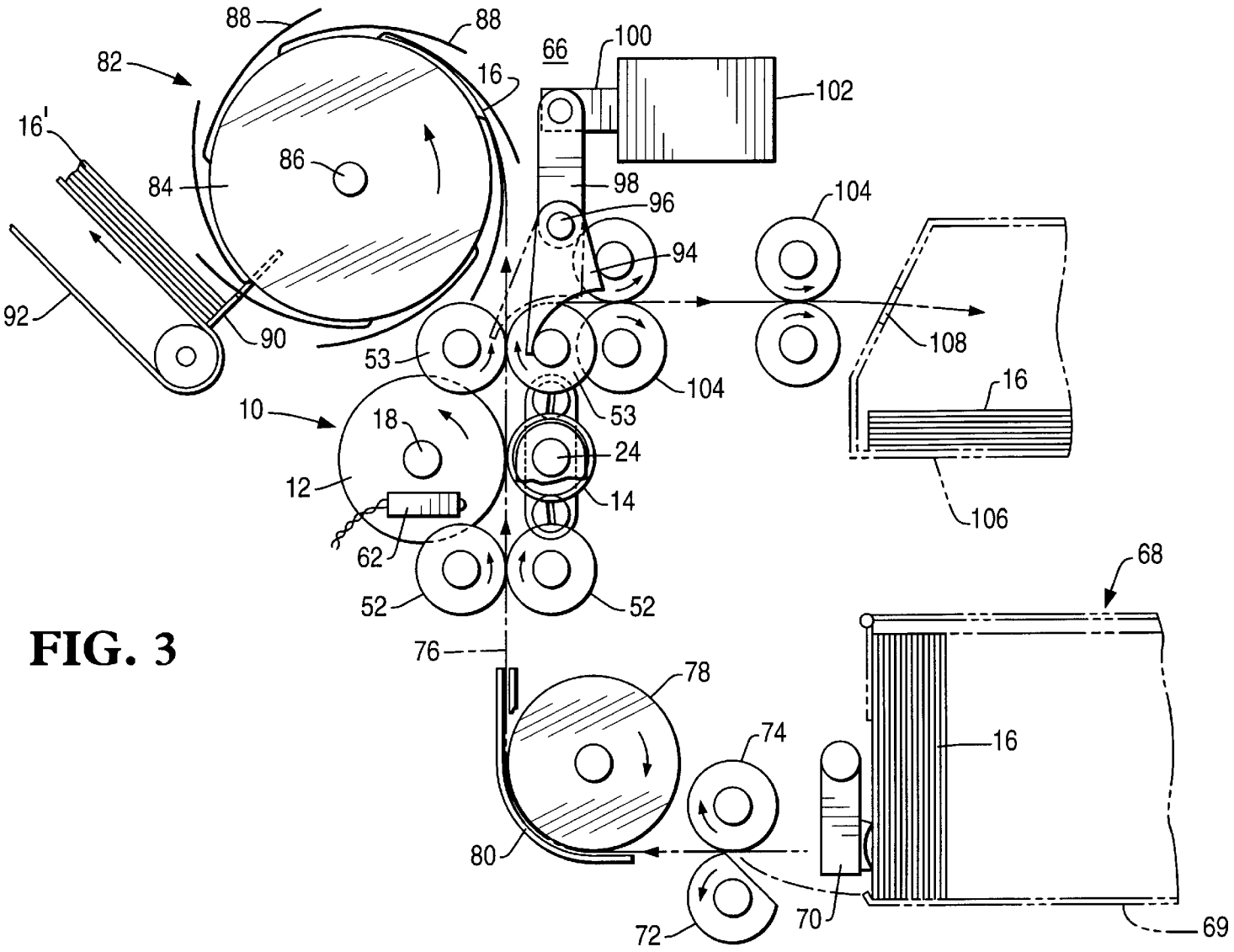
FIG. 3 is a schematic view of part of a cash dispensing mechanism incorporating the note sensing mechanism of FIGS. 1 and 2.

Referring now to FIG. 3, the note sensing mechanism 10 is included in a cash dispensing mechanism 66 of an ATM. The cash dispensing mechanism 66 includes a currency cassette 68 arranged to contain a stack of currency notes 16 of the same predetermined denomination, with corresponding long edges thereof resting on the base 69 of the cassette 68. The cassette 68 is associated with a pick mechanism 70. It should be understood that the cash dispensing mechanism 66 could include two or more currency cassettes, each associated with a pick mechanism, but in this embodiment only one currency cassette 68 and pick mechanism 70 will be described. When one or more currency notes are to be dispensed from the cassette 68 in the course of a cash dispensing operation, the pick mechanism 70 is pivoted in a clockwise direction so as to draw the lower portion of the first note in the stack out of the cassette 68 and into a position where the leading edge of this note is gripped between the curved periphery of pick roll means 72 of D-shaped cross-section and the periphery of co-operating roll means 74. The first note is fed out of the cassette 68 by the roll means 72 and 74, and is guided along a feed path 76 by a roller 78 and guide means 80 until the leading edge of the note is gripped by the feed rolls 52.

Each currency note extracted from the cassette 68 is fed by the feed rolls 52 to the nip of the rollers 12 and 14, and after passing between the rollers 12 and 14 the note is fed in normal operation by the feed rolls 53 to a conventional stacking wheel 82 which is arranged to rotate continuously in operation in an anti-clockwise direction. The stacking wheel 82 comprises a plurality of stacking plates 84 spaced apart in parallel relationship along the stacker wheel shaft 86, each stacking plate 84 incorporating a series of curved tines 88. The stacking wheel 82 is associated with a stripper plate 90 which is in the form of comb-like structure, and the tines 88 of each stacking plate 84 are arranged to pass between adjacent teeth of the stripper plate 90. In operation, each currency note fed by the feed rolls 53 to the stacking wheel 82 enters between adjacent tines 88 of the stacking wheel 82, the note being stripped from the stacking wheel 82 by the stripper plate 90 and being stacked against a normally stationary belt 92 with a long edge of the note resting against the stripper plate 90. When a bundle of notes 16' (or possibly a single note only) to be dispensed to a user of the ATM in response to a cash withdrawal request has been stacked on the belt 92, the belt 92 is operated by a separate motor 93 (FIG. 4) so as to transport the bundle of notes 16' towards a cash delivery slot (not shown).

A divert gate 94 mounted on a shaft 96 is positioned above the note sensing mechanism 10 in association with the feed rolls 53. One end of an arm 98 is secured to the shaft 96, the other end of the arm 98 being pivotally coupled to an armature 100 associated with a solenoid 102. The divert gate 94 is positioned close to the rollers 12 and 14, the spacing between the gate 94 and the nip of the rollers 12 and 14 being less than the circumference of the larger roller 12. This is made possible by the mode of operation of the note sensor mechanism 10 which will be described in detail later. Also, the mode of operation of the note sensor mechanism 10 makes it possible for the pick mechanism 70 to operate with a fast pick rate such that the spacing between the leading edges of successive notes fed to the note sensor mechanism 10 is also less than the circumference of the roller 12. As will be explained later, the solenoid 102 is arranged to be energized in response to the note sensing mechanism 10 detecting that a mutilated note or a multiple note has passed through the note sensing mechanism 10. The arrangement is such that with the solenoid 102 in a non-energized condition the divert gate 94 is in the position shown in solid outline in FIG. 3, out of the feed path 76 of currency notes from the guide roller 78 to the stacking wheel 82. Upon the solenoid 102 being energized, the armature 100 causes the divert gate 94 to be pivoted via the arm 98 and shaft 96 in a clockwise direction into the position shown in chain outline in FIG. 3 in which the divert gate 94 is positioned in feed path 76. With the divert gate 94 in this last-mentioned position, the divert gate 94 serves to guide mutilated or multiple notes to feed rolls 104 which feed the notes to a reject bin 106, the notes 16 being deposited into the bin through a slot 108.

Referring now to FIG. 4, in known manner and as is described for example in EP-B-0344938 the LVDT 42 is connected to signal processing means 112 which serves to convert the output of the LVDT 42 into a DC voltage between zero and +5 volts which varies linearly with movement of the armature 40 into and out of the LVDT 42 and which therefore also 15 varies linearly with angular movement of the axis of the roller 14 towards and away from the axis of the roller 12 (FIGS. 1 to 3). This last mentioned DC voltage is converted by an analog-to-digital (A/D) converter 152 into an 8 bit digital word.

The output of the A/D converter 152 is connected to data processing means 154. The outputs of the timing disc sensor 60 and of the datum mark sensor 62 are also connected to the data processing means 154. The data processing means 154 includes first data storage 156 in which is stored a null profile of the output of the AID converter 152. By the null profile is meant a series of sampled outputs (88 in the present embodiment) of the A/D converter 152 taken over one cycle of the rollers 12 and 14, that is to say over one complete revolution of the roller 12 when no note is passing between the rollers 12 and 14. It should be understood that as the two rollers 12 and 14 rotate with no currency note passing between them, the voltage output of the LVDT 42, and thus the digital value represented by the output of the A/D converter 152, will vary slightly due to various factors such as bearing wear and tolerances, dirt on the rollers 12 and 14 and roller eccentricity. Since the diameter of the fixed axis roller 12 is exactly twice that of the roller 14, all the variations (roller noise) will be substantially repetitive from one revolution of the roller 12 to the next.

The first data storage means 156 comprises 88 separate storage locations 156-1, 156-2, 156-3 . . . 156-88. The sampled outputs representing the null profile are respectively stored in these separate storage locations. In the sampling and storage procedure for storing the null profile, the data processing means 154 samples the 8 bit digital output of the A/D converter 152 for each timing pulse applied to the data storage means 154 by the timing disc sensor 60 and stores this output in the respective storage location of the storage means 156, the sampling and storage procedure commencing with application of a datum signal to the data processing means 154 in response to the sensing of the datum mark by the sensor 62. A counter 158 included in the data processing means 154 commences to count when the datum mark is sensed, and this instant represents the commencement of a cycle of the rollers 12 and 14. The count is incremented by one for each timing pulse, and the counter 158 is reset when a count of 88 is reached. The digital outputs of the A/D converter 152 for counts 1, 2, 3 . . . 88 of the counter 158 are respectively stored in the storage locations 156-1, 156-2, 156-3 . . . 156-88.

The data processing means 154 includes a comparator 160. In operation, the data processing means 154 determines when a single or multiple note commences to pass between the rollers 12 and 14 by sampling the output (digital value) of the A/D converter 152 for each timing pulse that the data processing means 154 receives and utilizing the comparator 160 to compare this output with the corresponding sampled output (digital value) stored in the storage means 156, that is to say with the stored output for the same point in a cycle of the rollers 12 and 14. For example, the digital value sampled for count 8 of the counter 158 is compared with the digital value stored in storage location 156-8. The data processing means 154 identifies the commencement of the passage of a single or multiple note between the rollers 12 and 14 when the comparator 160 identifies a significant difference between the compared digital values. Upon the data processing means 154 identifying such commencement, the data processing means 154 continues to sample the output of the A/D converter 152 for each timing pulse, and the digital value representing the sampled outputs are now stored in respective storage locations of second data storage means 162 included in the data processing means 154 in addition to being compared with corresponding digital values stored in the first storage means 156. The data processing means 154 continues with this sampling and storage procedure for as long as the single or multiple note is passing between the rollers 12 and 14. The data processing means 154 identifies when the single or multiple note has completed its passage between the rollers 12 and 14 when the comparator 160 ceases to identify a significant difference between the compared digital values. Upon the data processing means 154 identifying the cessation of the passage of the single or multiple note between the rollers 12 and 14, it ceases to store sampled digital values in the second storage means 162. Thus, it will be appreciated that there is stored in the second storage means 162 a series of digital values representing the outputs of the A/D converter 152 sampled during the passage of the single or multiple note between the rollers 12, 14. The particular location in the storage means 162 where the first digital value is stored depends on the count of the counter 158 when the commencement of such passage is identified. For example, if there are 37 digital values making up the series and the series commenced at count 10, then the digital values would be respectively stored in locations 162-10, 162-11, 162-12 . . . 162-46; alternatively if the count started at count 87 for the same number of digital values these values would be respectively stored in locations 162-87, 162-88, 162-1 . . . 162-35. If the comparator 160 identifies that there is a significant difference between the compared digital values for more than a predetermined number of timing pulses, then the data processing means 154 recognizes that two or more overlapping notes are passing between the rollers 12 and 14 and therefore terminates the sampling and storage procedure. These overlapping notes will be diverted to the reject bin after leaving the note sensing mechanism 10.

After the data processing means 154 has completed this last-mentioned sampling and storage procedure (assuming overlapping notes were not passing between the roller 12 and 14), the data processing means 154 calculates the sum of the series of digital values stored in storage means 162 to generate a first digital value sum, and also generate a second digital value sum by calculating the sum of those digital values making up that part of the null profile stored in storage means 156 corresponding to the part of the cycle of the rollers 12 and 14 when the single or multiple note was passing between them. The data storage means 154 then subtracts the second digital value sum from the first digital value to produce a resultant digital value which is stored in a memory location 178 in the data processing means 154. It will be appreciated that this resultant digital value is representative of the average thickness of that part of the single or multiple note engaged by the rollers 12 and 14, with the average thickness being taken across the width of the single or multiple note. The subtraction of the second digital value sum from the first digital value sum eliminates any possible problems due to roller noise, and in this connection since the relevant part of the null profile (corresponding to the part of the roller cycle for which the single or multiple note is passing between the rollers 12 and 14) is used in calculating the second digital value sum it does not matter as regards at which point in the roller cycle the single or multiple note enters the nip of the rollers 12 and 14.

After the resultant value representative of the average thickness of the just picked single or multiple note has been stored in the memory location 178, the data processing means 154 compares this value with the contents of a look-up table held in a memory location 180 in the data processing means 154, in order to determine whether the picked note is a single or multiple note. The contents of the look-up table in the memory location 180 comprise three discrete ranges of values respectively corresponding to 1, 2 and 3 notes. If the value stored in the memory location 178 falls within any one of these ranges, then the data processing means 154 makes the appropriate determination that a single, double or triple note has been picked. If the data processing means 154 makes a determination that a double or triple note has been picked, then the double or triple note will be diverted to the reject bin 106. Also, the data processing means 154 stores a record of the number of notes comprising the rejected multiple note for future reconciliation purposes. If the value stored in the memory location 178 does not match any of the ranges, then the picked single or multiple note is diverted to the reject bin 106 but no record is kept of the number of notes diverted. It will be understood that, in a normal pick operation, the pick mechanism 70 picks a single currency note from the currency cassette 68 for feeding to the stacking wheel 82 (FIG. 3).

In the present embodiment the roller 12 has a circumference of 180 millimeters. Since 88 timing pulses are generated for one complete revolution of the roller 12, it will be appreciated that, when a single or multiple note is passing between the rollers 12 and 14, samples of the output of the A/D converter 152 are taken at intervals of approximately 2 millimeters across the width of the note. In general, it is preferable that such samples should be taken at intervals of not more than approximately 2 millimeters.

The operation of the multiple note detect apparatus and of the associated parts of the cash dispensing mechanism 66 will now be described. This operation is controlled by the data processing means 154 which is connected to the main ATM processor 182. When the main ATM processor 182 requests that a particular number of currency notes be dispensed by the cash dispensing mechanism 66 from the currency cassette 68 (FIG. 3) in response to a cash withdrawal request by a user of the ATM, the data processing means 154 stores this number in a memory location 184. The data processing means 154 then switches on the motors 56 and 93 and activates the pick mechanism 70. It should be understood that the motor 56 controls the operation of the drive shaft 18, the feed rolls 52, 53 and 104, the cooperating roll means 72, 74, the roller 78 and the stacking wheel 82.

The data processing means 154 then stores in the data storage means 156, in the manner previously described, the digital values representing the null profile of the rollers 12 and 14. Next, the required number of notes are picked one by one from the currency cassette 68 by the pick mechanism 70.

Each picked currency note is fed along the feed path 76 to the feed rolls 52, and after passing through the feed rolls 52 the leading edge of the picked note enters the nip of the rollers 12 and 14. Thereupon, as previously described, the data processing means 154 causes to be stored in the data storage means 162 digital values representing the sampled outputs of the A/D converter 152 while the picked note is passing between the rollers 12 and 14. Again as previously described, the data processing means 154 generates a digital value representative of the average thickness of the picked note and makes a determination as to whether this is a single note or a multiple note. If the data processing means 154 makes a determination that a multiple note has been picked, then the data processing means 154 activates the solenoid 102 so as to cause the divert gate 94 to be pivoted from its normal position shown in solid outline in FIG. 3 to the position shown in chain outline. Thus, after a picked multiple note has passed between the rollers 12 and 14 it is diverted into the reject bin 106 (FIG. 3). Similarly, if the data processing means determines that two or more overlapping notes have been fed to the note sensor mechanism 10 then these overlapping notes are diverted to the reject bin 106. Thereafter, a further pick operation takes place. If the data processing means 154 makes a determination that a single note 16 has been picked, this note is allowed to travel on to the stacking wheel 82 for stacking on the belt 92 (FIG. 3), and the number stored in the location 184 is decremented by one. The location 184 now contains the number, if any, of notes still to be picked from the cassette 68 and stacked on the belt 92. If the number now contained in the location 184 is zero, then the operation of the pick mechanism 70 is terminated. If the number contained in the location 184 is not zero, then the data storage means 156 and 162 and the memory location 178 are cleared, and the cash dispensing operation is continued by performing one or more additional pick operations as previously described, until such time as the number contained in the memory location 184 has been reduced to zero.

When the number contained in the memory location 184 has been reduced to zero, the data processing means 154 terminates the operation of the pick mechanism 70. The bundle of notes 16' stacked at this time on the belt 92 comprises the total number of notes (possibly a single note) to be dispensed to the user of the ATM. The belt 92 is then operated so as to transport the bundle of notes 16' towards the cash delivery port (not shown) for collection by the user of the ATM, and the data processing means 154 switches off the motors 56 and 93 and clears the data storage means 156 and 162 and the memory locations 178 and 184.

Prior to an initial cash dispensing operation taking place, the look-up table held in the memory location 180 is established by passing a number of single notes, a number of double notes (i.e. two superposed notes) and a number of triple notes (i.e. three superposed notes) through the note sensing mechanism 10 so as to determine the ranges of digital values to be stored in the memory location 180. It should be understood that the digital value representing the thickness of a single picked note could fail to match the stored range of values for a single note if, for example, the note is torn or if parts of the note are joined together by adhesive tape. Also, it should be understood that the look-up table could be extended to include a range of values corresponding to 4 superposed notes, and possibly even a range of values corresponding to 5 superposed notes. However, it is extremely unlikely that as many as 4 or 5 notes would be picked in a single pick operation. Also, the look-up table could comprise just two ranges respectively corresponding to one and two notes.

The multiple note detect mechanism 10 described above has the advantage that a compact cash dispensing mechanism 66 is achieved, with the divert gate 94 being spaced from the nip of the rollers 12 and 14 by a distance of less than the circumference of the roller 12. Also, as previously explained, the mode of operation of the note sensor mechanism 10 enables the pick mechanism 70 to operate with a fast pick rate. A further advantage of the mechanism 10 is that roller noise is compensated automatically; this allows the rollers 12 and 14 and the related bearings to be manufactured to a lower tolerance, thereby providing a reduction in the manufacturing costs. Another advantage of the mechanism is in that mutilated notes can be detected and rejected.

What is claimed is:

1. An apparatus comprising:

a first roller having a diameter and a fixed axis of rotation;

a second roller having a diameter and an axis of rotation, the second roller being mounted such that the axis of the second roller is movable relative to the axis of the first roller and such that the second roller is biased towards the first roller to enable the second roller to be displaced away from the first roller in response to a single or multiple sheet entering a nip defined between the first and second rollers, the diameter of one of the first and second rollers being equal to or a multiple of the diameter of the other one of the first and second rollers, a voltage generating device for producing an output voltage which varies linearly with movement of the second roller towards or away from the first roller;

an analog-to-digital converter for receiving the output voltage from the voltage generating device and providing, an output representative thereof;

a memory for storing a series of digital values representative of sampled outputs of the converter;

a member for providing a reference mark which rotates in synchronism with the first and second rollers, the member comprising a timing disc which carries a datum mark;

a sensor for sensing the reference mark when the first and second rollers are rotating about their respective axes of rotation, the sensor including means for providing a datum signal when the sensor senses the datum mark on the timing disc; and a processor for (i) commencing sampling outputs of the converter when the sensor senses the reference mark and no sheet is passing between the rollers and storing these sampled outputs as a first series of digital values in the memory, (ii) sampling outputs of the converter while an item is passing between the rollers and storing these sampled outputs as a second series of digital values in the memory, (iii) comparing the first series of digital values and the second series of digital values, and (iv) generating a digital value which is representative of average thickness of that part of the item engaged by the rollers in the vicinity of the nip based upon comparison of the first and second series of digital values, the processor commencing sampling outputs of the converter when the sensor provides the datum signal.

2. An apparatus according to claim 1, wherein the sensor is of the optical type.

3. An apparatus according to claim 1, further comprising a diverting mechanism for diverting sheets to a rejection bin, the diverting mechanism being located relative to the first and second rollers such that the distance between the diverting mechanism and the nip between the first and second rollers is less than the circumference of the second roller.

4. An apparatus according to claim 1, further comprising a feeding mechanism for feeding sheets to the first and second rollers such that spacing between leading edges of successive sheets fed to the first and second rollers is less than the circumference of the second roller.

5. An apparatus according to claim 1, wherein the diameter of one of the rollers is twice the diameter of the other one of the rollers.

6. An apparatus for detecting the passage of superposed sheets along a feed path, the apparatus comprising:

a first roller having a fixed axis of rotation;

a second roller having an axis of rotation and being mounted such that the axis of the second roller is movable relative to the axis of the first roller and such that the second roller is biased towards the first roller to enable the second roller to be displaced away from the first roller in response to a single or multiple sheet passing between the rollers;

a voltage generating device which produces an output voltage which varies linearly with movement of the axis of the second roller towards or away from the axis of the first roller;

an analog-to-digital converter for receiving the output voltage from the voltage generating device and providing an output representative thereof, a memory for storing a series of digital values representative of outputs of the converter at regular intervals over a cycle of the rollers when no sheet is passing between the rollers;

a member for providing a reference mark which rotates in synchronism with the rollers and which provides a reference point for a cycle of the rollers, the member comprising a timing disc which carries a datum mark;

a sensor for (i) sensing the reference mark, and (ii) providing a signal indicative thereof, the sensor including means for providing a datum signal when the sensor senses the datum mark on the timing disc; and a processor for (i) determining when an item comprising one or more sheets commences to pass between the rollers based upon the signal from the sensor, (ii) sampling the output of the converter at regular intervals while the item is passing between the rollers; (iii) determining when the item ceases to pass between the rollers, and (iv) utilizing sampled outputs of the converter and stored digital values corresponding to that part of the cycle for which the item is passing between the rollers to generate a further digital value which is representative of the average thickness of that part of the item engaged by the rollers and which provides a basis for determining whether the item comprises a single sheet, the processor determining that an item comprising one or more sheets is commencing to pass between the rollers when the sensor provides the datum signal.

7. An apparatus according to claim 6, wherein the sensor is of the optical type.

8. An apparatus according to claim 6, wherein the processor determines when the item commences to pass between the rollers or ceases to pass between the rollers by comparing each output of the converter with a stored digital value representative of the output of the converter at the corresponding point in the cycle of the rollers when no sheet is passing between the rollers.

9. An apparatus according to claim 6, further comprising a feeding mechanism for feeding sheets along the feed path to the rollers with spacing between leading edges of successive sheets being less than the circumference of the one of the rollers.

10. An apparatus according claim 6, wherein the processor samples the output of the converter at intervals corresponding to less than approximately two millimeters in the direction of feed of the item between the rollers.

* * * * *